United States Patent [19]

Steinbock

[11] 3,945,234

[45] Mar. 23, 1976

[54] TANDEM ROLLING MILL ARRANGEMENT

[76] Inventor: Rolf Steinbock, 603 Lindsay Road, Carnegie, Pa. 15106

[22] Filed: Jan. 2, 1975

[21] Appl. No.: 538,111

[52] U.S. Cl. ..... 72/235; 72/238

[51] Int. Cl.[2] ..... B21B 13/12

[58] Field of Search ..... 72/234, 235, 238, 226, 72/237

[56] References Cited

UNITED STATES PATENTS

| | | | |
|---|---|---|---|
| 564,302 | 7/1896 | Brightman | 72/235 |
| 780,644 | 1/1905 | Edwards | 72/235 |
| 2,023,913 | 12/1935 | Carroll | 72/235 |
| 3,136,185 | 6/1964 | Benteler | 72/235 |
| 3,243,983 | 4/1966 | Norlindh et al. | 72/235 |
| 3,319,449 | 5/1967 | Hill | 72/237 |

*Primary Examiner*—Milton S. Mehr

*Attorney, Agent, or Firm*—Brown, Murray, Flick & Peckham

[57] ABSTRACT

Alternative tandem arrangements of rolling mill stands are formed by supporting a plurality of separate and independently operable rolling mill stand assemblies upon one or more pedestals extending along a given passline. In one disclosed embodiment, a single pedestal extends along the passline and includes an angularly-shaped plate extending parallel to the passline and including inclined surfaces for carrying rolling mill assemblies at spaced locations. Auxiliary adapter pedestals are disclosed to position a rolling mill stand such that the rotational axes of its rolls are inclined in a different relation to the horizontal than when the mill stand is supported directly by the angularly-shaped plate on the pedestal. In a second embodiment, a plurality of side-by-side pedestals extend along a passline. Each pedestal defines a separate rolling mill support surface with the support surfaces of adjacent pedestals lying in intersecting support planes. An improved rolling mill stand assembly is disclosed. The mill stand assembly includes a box-like frame with housing plates located in a spaced-apart relation for resisting a separating force developed between a pair of rotating rolls supported thereby. A separate motor and gear drive are supported by the frame of each mill. The housing plates have aligned bores that receive eccentric bushings for adjusting the gap between the rolls. One housing plate is a permanent part of the frame while the other housing plate is attached by bolts to the frame for removal during roll changing.

17 Claims, 7 Drawing Figures

TANDEM ROLLING MILL ARRANGEMENT

BACKGROUND OF THE INVENTION

This invention relates to apparatus to provide tandem rolling mill arrangements wherein the relative disposition of one rolling mill stand relative to another is independently and readily changeable to orientate the rotational axes of the rolls, hence the roll pass design, relative to a given passline. More particularly, the present invention relates to an improved construction for separate and independent rolling mill stands and to pedestal means for the support of such mill stands at preselected locations and inclined relationships to provide a desired tandem arrangement of rolling mill stands.

A tandem arrangement of rolling mill stands is defined for the purpose of this invention to mean a plurality of mill stands supported and arranged so that during the rolling process a workpiece will progress from one stand to the next along a continuous straight path. The features and advantages of the present invention are particularly useful for numerous tandem arrangements forming continuous jobbing-type mill trains including universal mill trains for rolling metallic workpieces to produce products commonly referred to in the art as flats, rebars, angles, channels, round and squares. Modern high-speed and high-production bar mills incorporate massive and specially designed individual mill stands arranged to form a continuous mill train with alternate mill stands providing horizontally-and vertically-arranged rolls to alleviate the necessity for twisting the bar or workpiece between adjacent mill stands. When it is necessary to twist the bar between mill stands, guides are specially designed for this purpose but they have inherent disadvantages including marking of the bar or other forms of workpieces. The guides represent a substantial and added expense for each mill stand and the guides must be periodically replaced due to different roll pass designs and due to wear of the guiding surfaces. In the standard horizontal-vertical continuous mill arrangement, the horizontal mill stands are driven by heavy-duty drives that are independently supported at spaced locations from the mill stands and the vertical mill stands are coupled to a separate drive usually located within a pit below the mill stand itself or on a massive steel structure above the mill. There are still other numerous forms of rolling mill arrangements particularly, for example, in regard to the rolling of smaller workpieces such as rods wherein the mill stands are arranged at a 45° angle to the horizontal with adjacent mill stands being offset at 90° to each other. This mill arrangement permits the rolling of rod using roll passes without the need to twist the rod between pairs of rolls. Variations to this arrangement of rolls for a rod mill cannot be provided since the arbors for the rolls are rotatably carried by a single rigid structure and it is not possible to alter or change the disposition of one pair of rolls in a given mill stand with respect to another pair of rolls in a different mill stand.

These tandem or otherwise continuous arrangements of rolling mills are typically used in steel producing facilities where high tonnage output from the mills is expected and where the product produced by a tandem mill does not change to any great extent on a day-to-day basis. Such mill arrangements are not, however, suitable for continuous jobbing-type mill trains where a variable rolling schedule demands consecutive passes to be provided by rolls with their rotational axes angularly disposed at 90° to each other but in different angular relations to the horizontal. In other words, a given rolling schedule may require that the mill stands are disposed at alternate vertical sides of a given passline and that each mill stand forms an angle of 45° to the horizontal. The next rolling schedule will require a tandem mill train, for example, wherein a given rolling mill stand has the rotational axes of its rolls arranged parallel to the horizontal while the next succeeding rolling mill stand has the rotational axes of its rolls arranged vertically or perpendicular to the horizontal. In the jobing mill type of tandem mill trains, there are other instances which render it desirable, if not necessary, that the rolls in the mill stands have their rotational axes disposed at different angles other than as just described. For example, for special products, a rolling sechedule may provide that a first mill stand has the rotational axes of its rolls arranged at an angle of 30° to the horizontal and then the next succeeding rolling mill stand has the rotational axes of its rolls arranged at an angle of 60° to the horizontal. Other considerations, together with rolling schedules, may render it necessary to arrange all the mill stands at one vertical side of the passline.

The capital investment for facilities required to convert one tandem mill arrangement into another and the time needed to accomplish the change are important factors that affect the production costs of the rolling mill facility. Thus, it becomes highly desirable to not only provide apparatus which is versatile in its use but also designed for providing such facilities at a minimum of capital investment so as to be economically feasible to produce rolled products at low tonnage volumes.

SUMMARY OF THE INVENTION

It is an object of the present invention to provide a low-cost continuous rolling mill arrangement wherein a plurality of rolling mill stand assemblies are separately and independently operable while supported at preselected locations along a passline at one of a variety of different angularly-disposed relations with respect to the horizontal.

It is a further object of the present invention to substantially reduce the cost and capital investment needed for providing a continuous jobbing-type mill train wherein tandem mill stand arrangements for the continuous rolling of a variety of products can be changed in a rapid and efficient manner.

It is still a further object of the present invention to provide an improved construction and arrangement of parts for separate and independent rolling mill stands employed in a versatile tandem mill arrangement for an efficient and rapid roll changing so that the mill stands can be readily manipulated and supported at desired positions to form part of different tandem rolling mill arrangements for producing workpieces with a variety of rolled shapes or sizes.

It is still another object of the present invention to provide a tandem rolling mill for carrying out successive rolling operations by employing a plurality of separate and independent mill stands, each supported by pedestal means for the selective positioning thereof so that the rotational axes of the rolls are disposed at preselected angular planes to the horizontal while each roll pass defined by the rolls lies along a preestablished passline.

It is still a further object of the present invention to provide pedestal means defining a plurality of rolling mill support surfaces at spaced-apart locations along a preselected passline for the independent support of separate mill stands at desired angularly-disposed relations to the passline for providing alternative tandem arrangements of the mill stands.

According to the present invention, there is provided apparatus for alternative tandem mill arrangements of rolling mill stands to process workpieces by successive rolling operations along a given passline. The apparatus comprising, in combination, a plurality of separate and independently operable rolling mill stand assemblies each including housing means for rotatably supporting a pair of rolling mill rolls which defines a roll gap wherein a workpiece is processed, and separate drive means including a motor for rotating the rolls of each rolling mill stand assembly, and pedestal means defining a plurality of separate support surfaces each adapted to support and independently position one of a plurality of rolling mill stand assemblies at a preselected location along the passline, certain of the support surfaces being at different angular positions with respect to others and each of the rolling mill stand assemblies being removable from an associated one of the support surfaces independently of other rolling mill stand assemblies.

In one embodiment of the present invention, the aforesaid pedestal means take the form of a single pedestal having at the upper end thereof two angularly-arranged plates with their adjoined longitudinal edges extending parallel to the passline and with the plates forming inclined surfaces to the horizontal for the support of rolling mill stands. These plates either directly support a rolling mill stand assembly or one of a plurality of auxiliary adapter pedestals forms an intermediate support member for a given rolling mill stand assembly.

In a second embodiment of the present invention, the aforesaid pedestal means take the form of a plurality of separate pedestals extending in a side-by-side relation along the passline for the independent support of a rolling mill stand assembly. The support surfaces of adjacent pedestals being angularly disposed and lying with intersecting planes of support for a mill stand whereby the rotational axes of the rolls of a mill stand while supported by a given pedestal lie in a fixed relation to the horizontal and a different angular relation when that mill stand is supported by an adjacent pedestal.

The present invention further provides an improved rolling mill stand assembly comprising the combination of a frame having side walls forming a generally box-like structure with internal portions including a permanent housing plate and remote thereto spaced-apart drive support plates, the frame further including a removable housing plate secured to the side walls of the frame in a spaced-apart relation to the permanent housing plate, a pair of rolls having workpiece-engaging bodies extending between the housing plates, drive gears supported between the drive support plates, coupling means between the permanent housing plate and one of the drive plates for rotatably interconnecting the rolls with the drive gears, and a motor supported by the frame to rotate at least one of the drive gears for driving the rolls while engaging a workpiece passing therebetween.

These features and advantages of the present invention as well as others will be more readily understood when the following description is read in light of the accompanying drawings, in which.

Figure 1:
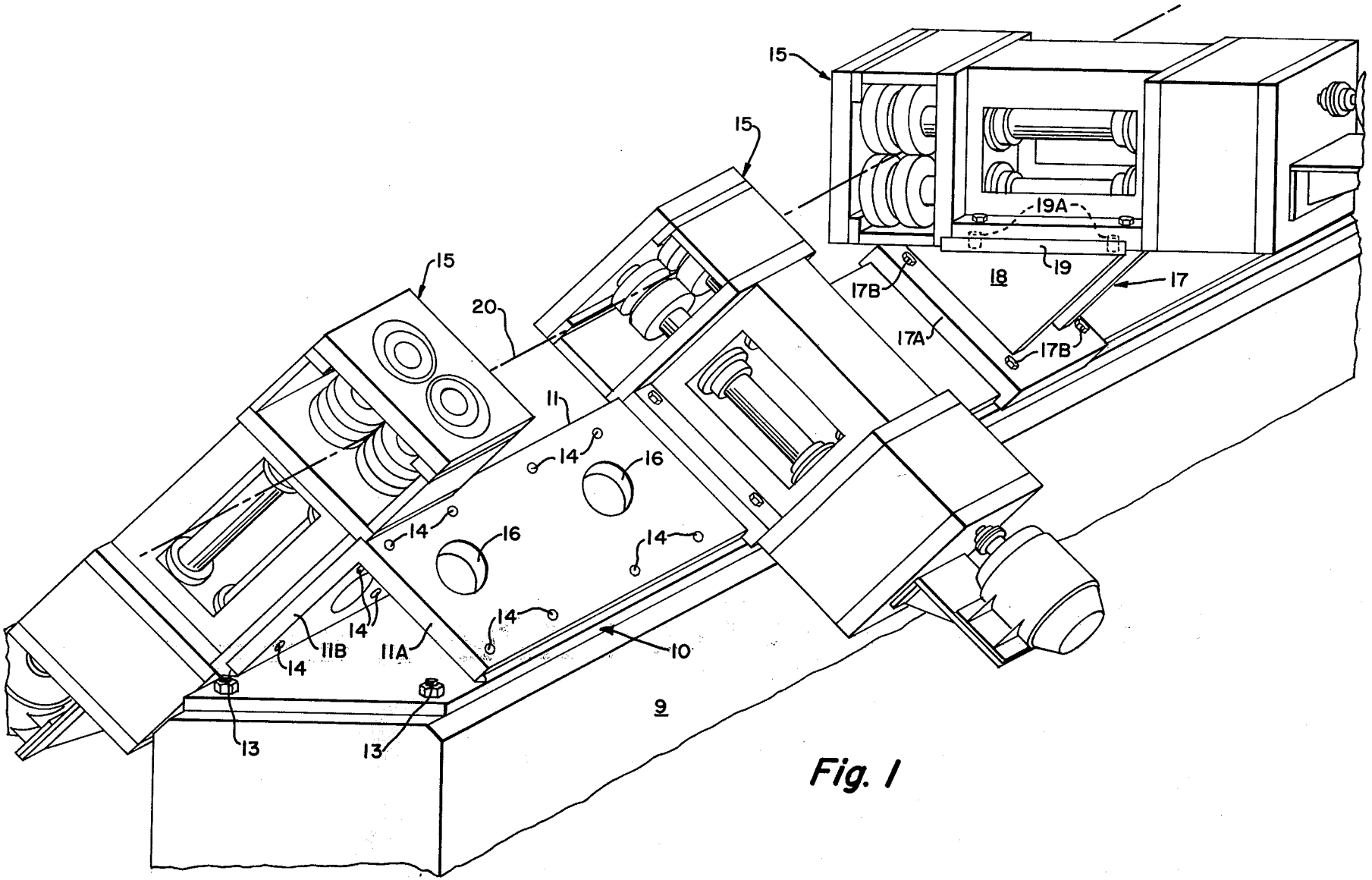
FIG. 1 is a perspective view of a support pedestal according to one embodiment of the present invention for a tandem mill arrangement.

In FIG. 1, there is illustrated a vertically-extending pedestal base 99 that takes the form of a rectangularly-shaped block-like structure made of concrete or other suitable materials. The top surface of the pedestal base 9 carries a pedestal assembly 10 which is welded or otherwise constructed from steel plate consisting of an equal angle plate 11 having equal length legs 11A and 11B that are welded or otherwise secured to a base plate 12 so as to form a roof-like pedestal assembly. This assembly is secured by nuts 13 cooperatively engaging foundation bolts embedded within the concrete of the base pedestal 9. The plates 11A and 11B form equal angles to the horizontal, each at 45°. The exposed face surfaces of plates 11A and 11B define pedestal support surfaces at horizontally spaced-apart locations for separate and independent rolling mill stand assemblies 15. The actual support surfaces provided by these pedestal assemblies 10 may be defined in a number of different ways. For example, a machined pad may be attached to the plates. In certain instances, the machined pad can be defined by the actual plate surface or the rolling mill support surfaces may be defined by a series of drilled holes 14 to receive suitable fastening means such as nut and bolt assemblies for attaching a given rolling mill stand to the pedestal assembly. To facilitate the mounting of a rolling mill stand, an access hole 16 is provided in the plate opposite the plate which is actually employed to support the rolling mill stand. The acess holes 16 are also useful to pass coolant supply lines from the enclosed space under the roof for use with a rolling mill stand. In this way, workmen gain access to the undersurface of the plates to torque the nut and bolt assemblies. Alternatively, the holes 14 may be threaded to receive mounting bolts for securing a rolling mill housing to a pedestal support surface.

The separate and independent rolling mill stand assemblies 15 are supported by the pedestal at spaced locations along the length thereof and these rolling mill stand assemblies can be oriented with respect to each other to form pedetermined tandem rolling mill arrangements according to a given schedule. Thus, for example, as illustrated in FIG. 1, a first rolling mill stand in the tandem arrangement is inclined at 45° to the horizontal at one side of the pedestal while the next succeeding rolling mill stand is inclined at 45° to the horizontal but at the other side of the pedestal. The next succeeding rolling mill stand is located on the same side of the pedestal as the immediate adjacent stand but the rotational axes of the rolls lie in a plane that is parallel to the horizontal. To accomplish this, an auxiliary adapter pedestal 17 is provided and includes a base plate 17A with drilled holes 17B located for an aligned relation with the holes 14 in the plate 11A. The base plate 17A carries two angular bracket plates 18 which, in turn, support a rolling mill support plate 19 having its supporting surface arranged coplanar with the horizontal and defining holes 19A disposed in the same spaced-apart relation as the holes 14.

The rolling mill stands 15 are constructed such that they maintain basic dimensional relations constant for each rolling mill stand when they are supported by a pedestal or an auxiliary adapter pedestal whereby a preselected passline 20 extends horizontally between each mill stand while passing through the gap defined by the roll pass of the rolls.

As will be described in greater detail hereinafter, the rolling mill stand assemblies are constructed to form separate and independent rolling mill assemblies that can be oriented independently in a desired relation to the passline without regard to an adjacent mill stand or drive requirements therefor. FIG. 1 illustrates one of many possible tandem mill arrangements utilizing the support surfaces provided by the pedestal 10. For example, when a given rolling mill schedule requires rolling mill stands alternatively disposed at 45° from the horizontal along the passline, such a tandem mill arrangement can be quickly provided by attaching the mill stands directly upon the pedestal. The rolling mill stands can be supported at opposite sides of the pedestal or, alternatively, the mill stands can be supported at the samd side of the pedestal through the agency of suitable auxiliary adapter pedestals. In this regard, those skilled in the art will readily understand that the plates 18 of auxiliary adapter pedestal 17 can be dimensioned so that plates 17A and 19 form an angle of 90° instead of 45° which FIG. 1 is intended to illustrate. As will be seen, the mill stands are designed in such a manner that the rolls can be rapidly and efficiently changed so that at the conclusion of production according to a given rolling schedule, a particular mill stand can be quickly readied for the next rolling schedule by changing the rolls to make available the mill stand for use with a desiredd roll pass design.

Figure 2:
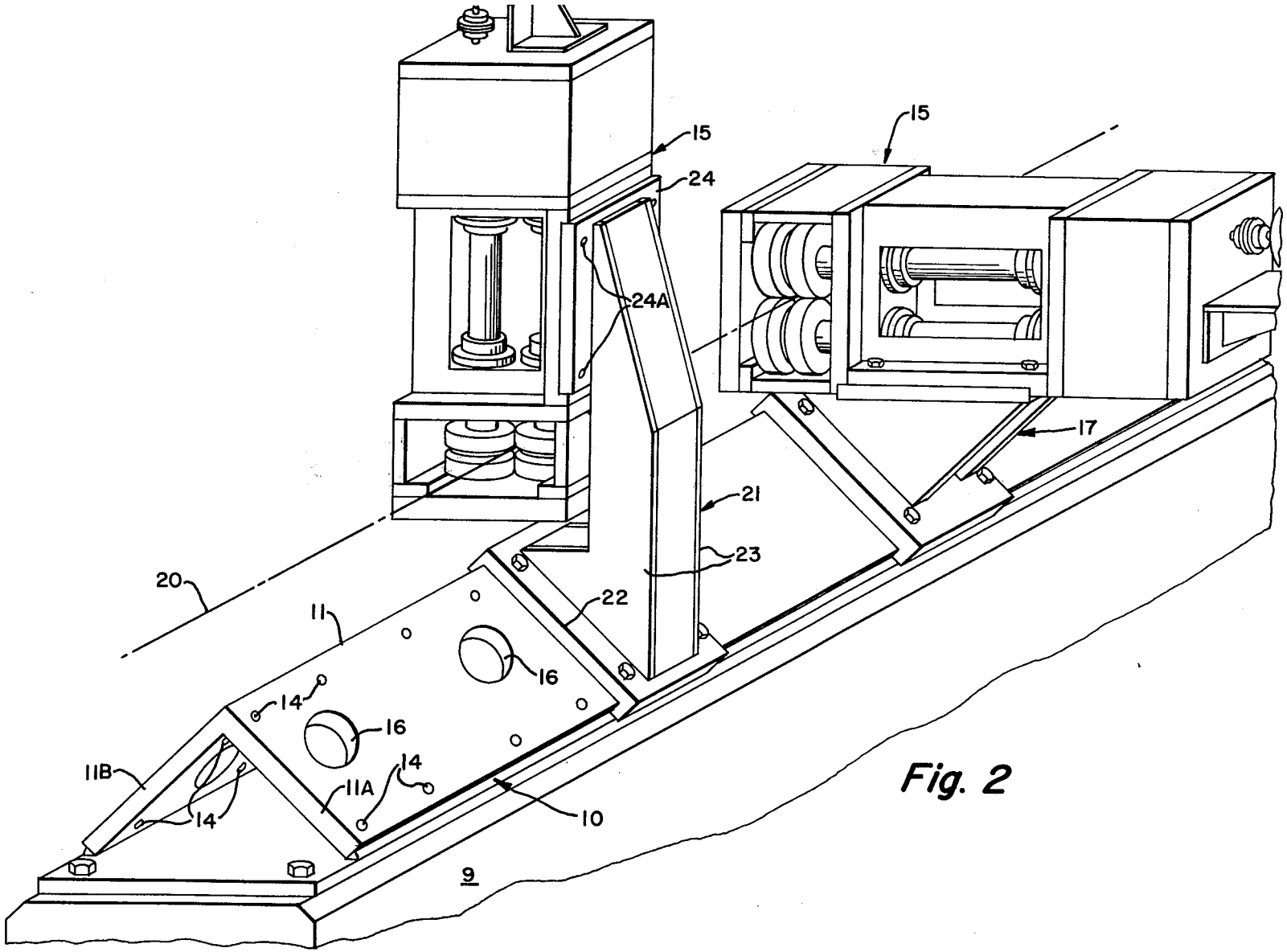
FIG. 2 is a view similar to FIG. 1 and illustrating the use of the support pedestal to form a second tandem rolling mill arrangement.

FIG. 2 illustrates the same base pedestal 9 and pedestal assembly 10 as illustrated by FIG. 1 but employed to provide a tandem arrangement wherein the mill stands are arranged such that the rotational axis of one roll stand is vertical while the next adjacent roll stand has the rotational axes of its rolls disposed parallel to the horizontal. FIG. 2 illustrates only a portion of a tandem rolling mill arrangement. The tandem mill arrangement shown in FIG. 2 includes the use of the auxiliary adapter pedestal 17 to support a rolling mill stand with the rotational axis thereof parallel to the horizontal. The pedestal 10 also supports a rolling mill stand 15 by an auxiliary adapter pedestal 21. The pedestal 21 is constructed to position and form an intermediate support for a mill stand so that the rotational axes of its rolls form an angle of 90° with the horizontal. Adapter pedestal 21 includes a base plate 22 with vertically-extending arms 23 that carry at their upper ends a rolling mill support plate 24 with the support surface thereof lying in a vertical plane to which a rolling mill stand is independently attached by bolts utilizing holes 24A. These holes are located in the same spaced-apart relation as holes 14.

Figure 4:
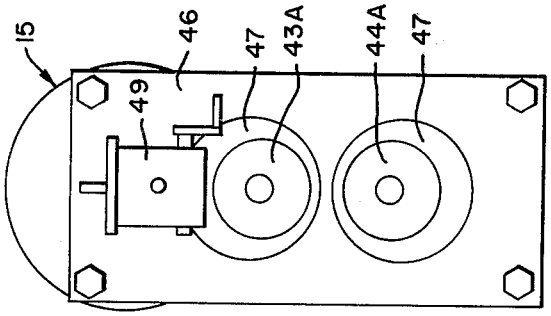
FIG. 4 is an end elevational view of the rolling mill stand illustrated in FIG. 3.
Figure 3:
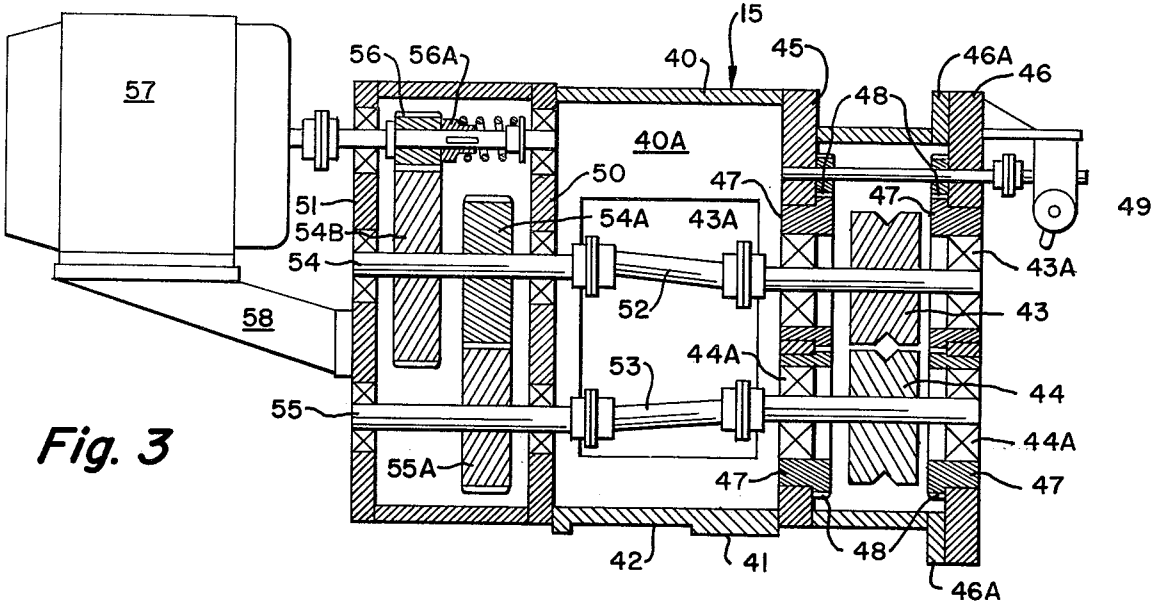
FIG. 3 is a side elevational view, in section, of a rolling mill stand assembly embodying the features of the present invention.

FIGS. 3 and 4 illustrated in greater detail the construction and arrangement of parts forming each of the rolling mill stands 15. It is important to note that each mill is driven by its own separate drive and motor which are an integral part of the mill stand. In this way, the mill stand is operatively independent of its particular location and angular disposition. This has not been possible in the past where a combined form of drive was foundation-mounted in a permanent fashion apart from the mill stands driven thereby.

Each rolling mill stand includes a welded steel, box-like spacer frame 40 including a bottom support plate 41 adapted to rest on and be firmly secured to the support surfaces defined by a pedestal. A slot 42 in the bottom plate 41 is arranged for locating the mill stand on the support surfaces of the pedestal so that the usual passline formed by the rolls of the mill stand will be in registry with the passline of the mill train. The mill stand includes two rolls 43 and 44 with body portions which are machined to provide a desired shape to a roll pass opening at the gap between the rolls. The opposite ends of the rolls are rotatably supported by bearings 43A and 44A, respectively, that are received in aligned annular bores formed in spaced-apart housing plates 45 and 46 that resist the rolling forces produced during the processing of a workpiece between the rolls. The rolls are positioned by fitting the bearing on the journals therefor within eccentrically bored sleeves 47 positioned within the annular openings in the housing plates. By rotating the eccentric sleeve within the annular opening in the housing plates, the spacing between the rolls is changeable. Each of the eccentric sleeves 47 includes a collar with an enlarged diamenter that overlaps the face surface of the associated housing plate. Gear teeth 48 are machined in these collars so that the top and bottom eccentric sleeves mesh and rotate together for adjusting the roll gap. A set of small gears connected by a shaft rotates the front and rear eccentric sleeves together, so that all four eccentric sleeves move together. The connecting shaft is rotated by a worm gear reducer 49 having a large speed reduction so as to be self-locking. If desired, the drive input shaft may have flats on the end so that the small gears can be rotated with a wrench. A locking device, such as a lock screw, will prevent movement of the eccentric sleeves after the adjustment.

It is an important feature of the present invention that the outer housing plate 46 is independent of the integral frame 40. A row of spaced-apart holes along the top and bottom edges of the plate 46 receives bolts used to attach the housing plate 46 to flange 46A that is part of the frame 40. In this way, the housing plate 46 can be quickly removed in an efficient manner for the changing of the roll or roll sleeves. The housing plate 45 is welded or bolted to the spacer frame 40. The box-like form of frame 40 has side walls 40A and internal portions. Also welded or bolted to the spacer frame is plate 50 which is part of the gear case. An end wall is formed by a drive support plate 51 and the opposite end wall is formed by the housing plate 46 when bolted to the flange 46A. The top and bottom side walls 40A are continuous and extend between the housing plates 46 and 47 while the vertical side walls do not extend between the housing plates so that workpieces can enter and exit from the roll gap. Within the frame 40 spindles 52 and 53 are coupled to an end of the rolls 43 and 44, respectively. The spindles are, in turn, coupled to shafts 54 and 55 that, in turn, carry meshing pinion gears 54A and 55A, respectively. Depending on the particular power requirements, speed requirements and other consideration, the pinion gear 54A may be driven by a gear 56 secured to the shaft of a motor 57. It is preferred, however, to utilize the space between the drive support plates 50 and 51 to form a gear case in which an additional train of gears is rotatably supported by these plates for drivingly interconnecting the gear 56 to the pinion gear 54A. As illustrated in FIG. 3, the motor 57 is supported by a bracket 58 extending in a cantilevered fashion from the frame 40. It will thus be observed that the motor, the gear drive, spindles and the rolling mill rolls are an integral unit that can be moved from place-to-place and specifically, this unitary rolling mill can be positioned on any one of the support surfaces provided by the previously-described base. The rolling mill stand assemblies of the present invention can be manufactured at a relatively low cost as compared with known designs of rolling mills for comparable rolling operations. To obtain a low-cost design the gears for driving the rolling mill rolls are relatively small and have good wear properties such as by case-hardening the teeth of the gears. To offset the lower strength of the smaller gears during sudden but momentary emergency overloads, an overloading device is incorporated into the mill assembly. The function of the overload device is to isolate the momentum of the motor, i.e., the $WR^2$ of the rotating motor mass, from the relatively low mass of the rotating parts of the mill stand. The overload device can be a shear pin coupling, an undercut area in a gear shaft or a non-breaking slip coupling device. FIG. 3 illustrates a non-breaking slip coupling device 56A which is associated with pinion gear 56.

The economical features of the present invention are particularly enhanced by the use of plates instead of the conventional cast steel housings for rolling mills. The housing plates 45 and 46 of the present invention have the advantage that they can be machined from steel plate at a relatively low cost. Such housing plates can easily resist a separating or rolling force of the order of 12,000 pounds per square inch as compared with the usual practice of using cast steel housings which are usually designed to resist a separating force of only about 1000 pounds per square inch. Thus, the present invention provides a versatile, lightweight, low-cost unitary rolling mill with an equal or greater capacity as compared with known mill designs.

Figures 5, 7:
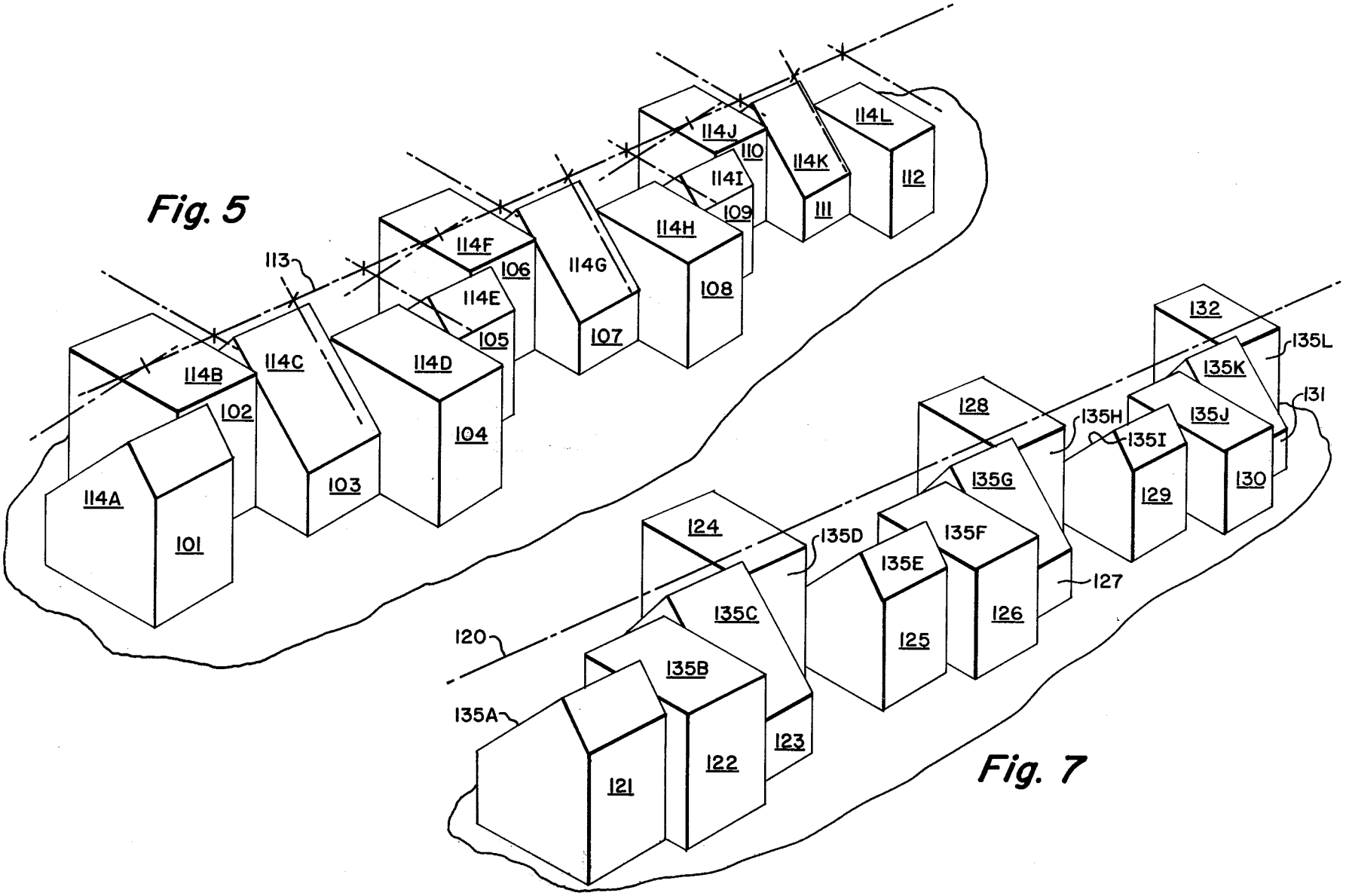
FIG. 5 is a perspective view of side-by-side pedestals according to a second embodiment of the present invention for providing a tandem mill arrangement.
FIG. 7 is a view similar to FIG. 5 and illustrating a modified arrangement of side-by-side pedestals.

In FIG. 5, there is illustrated vertically-extending pedestals 101–112 arranged in a side-by-side relation to extend below and along the direction of a rolling mill passline generally indicated at 113. The pedestals may be united together to form one integral unit or they may be separate and independent of one another. In their preferred form, the pedestals are foundation-like structures comprised of reinforced concrete with bolts or other forms of fastening means embedded within the concrete to secure a rolling mill stand asseembly to planar support surfaces of the pedestals which are identified in FIG. 5 as 114A–114L. Thus, it can be seen that the support surface 114A is inclined at an angle of 45° to the horizontal; surface 114B is horizontal; surface 114C is inclined at 45° opposite to the inclination of surface 114A; surface 114D is horizontal; surface 114E is inclined at 45° to the horizontal opposite to the inclination of surface 114C; surface 114F is horizontal; surface 114G is inclined at 45° opposite to the inclination of surface 114E; surface 114H is horizontal; surface 114I is inclined at 45° to the horizontal opposite to the inclination of surface 114G; surface 114J is horizontal; surface 114K is inclined at 45° to the horizontal opposite to the inclination of surface 114I and the last pedestal defines a horizontal support plate 114L.

Figure 6:
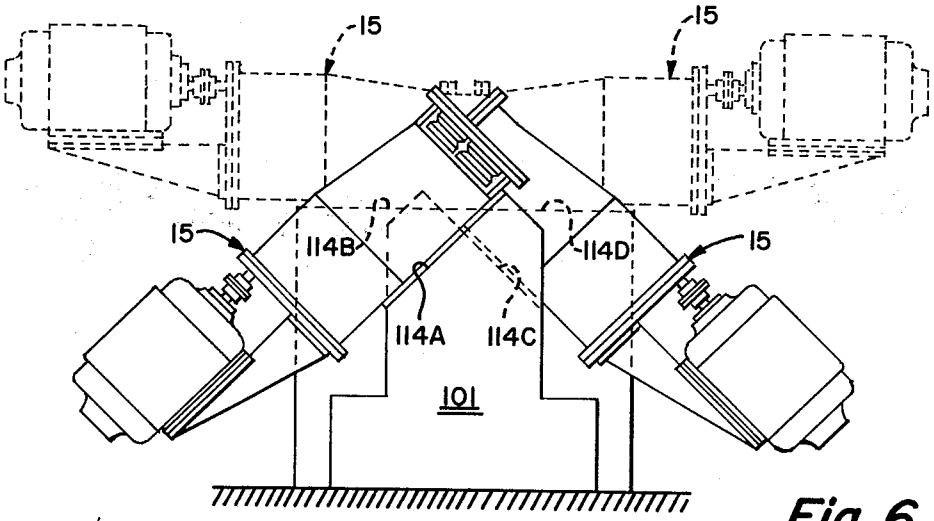
FIG. 6 is an end elevational view of the pedestals shown in FIG. 5 and further illustrating the rolling mill stands supported thereby.

The tandem rolling mill concept illustrated by FIG. 5 provides for the support of a given rolling mill at different times upon certain of the pedestal support surfaces 114A–114L. Thus, for example, when a given rolling schedule requires a rolling process wherein the rolling mill stands are alternately disposed at 45° from the horizontal along the passline, such a tandem rolling mill arrangement can be quickly provided by locating a mill stand 15 upon each of the support surfaces. This type of rolling schedule is typically used in the production of round, oval or square-shaped workpieces. A different rolling schedule may require the use of mill stands such that the rolls thereof rotate about parallel axes. This can be readily provided by first removing the mill stands from one mounting surface of the base and then fastening them to the other surface arranged at a 90° angle from the first surface. This tandem rolling mill arrangement is typically used for rolling of channel sections, flats and angles. It will also be apparent from the foregoing that combinations of parallel mill stand assemblies together with mill stand assemblies located perpendicular to them can be utilized in a tandem mill train to carry out a given rolling schedule. FIGS. 5 and 6 illustrate that the support surfaces for two rolling mill stands are located at one hroizontal side of line 113 and the next two support surfaces are located at the opposite side of the passline. This enables greater access by workmen to the mill stands for performing needed operations such as adjusting and aligning the rolls, positioning the mill stands themselves relative to the passline and performing such other usual servicing operations as may be needed from time-to-time.

FIG. 7 illustrates a second embodiment of the present invention in regard to the arrangement of adjacent pedestals for the support of mill stands. This embodiment differs from that previously described in that in addition to providing a tandem rolling mill arrangement made up of alternately-disposed mill stands at 45° to the horizontal, there can additionally be provided mill stands supported in horizontal and vertical relations for greater flexibility to accommodate desired rolling schedules. The pedestals 121–123 extend vertically in a side-by-side relation to extend along and below a passline 120 of any given tandem mill train. These pedestals define a first mill stand support surface 135A which is inclined at 45° to the horizontal. The next adjacent pedestal 122 has a horizontal support surface 135B. The next adjacent pedestal 123 has an inclined support surface 135C arranged at 45° but opposite to the inclination of the support surface 135A. The next adjacent pedestal 124 has a vertical support surface 135D. The just-described arrangement of support surfaces of the pedestals 121–124 are twice repeated by two additional series of pedestals 125–128 and 129–133 whereby these additional series of pedestals define similar support surfaces 135E–135H and 135I–135L, respectively. It will be understood, of course, that the selection and determination of a rolling mill stand to be supported by a given one of the pedestals will be made on the basis of at least the particular roll pass defined by the rolls of a mill stand.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. An apparatus for providing alternative tandem arrangements of rolling mill stands to process workpieces by successive rolling operations along a given passline, said apparatus comprising, in combination:

a plurality of separate and independently operable rolling mill stand assemblies each including housing means to rotatably support a pair of rolling mill rolls which defines a roll gap wherein a workpiece is processed, and separate drive means including a motor for rotating the rolls of each rolling mill stand assembly; and pedestal means defining a plurality of separate support surfaces each adapted to support and independently position one of said plurality of rolling mill stand assemblies at a preselected location along said passline, certain of said support surfaces being at different angular positions with respect to others and each of said stand assemblies being removable from an associated one of said support surfaces independently of the others, said separate support surfaces define a support location by said pedestal means for each of said rolling mill stands to form part of at least two alternative tandem rolling mill arrangements which include a first tandem rolling mill arrangement wherein the rotational axes of the rolls of at least two separate mill stands form an angle of at least 45° to the horizontal, and a second tandem rolling mill arrangement wherein the rotational axes of the rolls of at least two separate mill stands form an angle less than 45° to the horizontal.

2. The apparatus according to claim 1 wherein said support surfaces defined by said pedestal means are inclined at 45° to the horizontal for supporting and positioning at least two of said rolling mill stand assemblies for said first tandem rolling mill arrangement.

3. The apparatus according to claim 1 wherein said pedestal means are further defined to include a plurality of vertically-extending pedestals such defining an individual one of said separate support surfaces for supporting and positioning one of said plurality of rolling mill stand assemblies, said vertically-extending pedestals being arranged in a side-by-side relation along said passline such that the support surfaces of adjacent pedestals are angularly disposed and lie within intersecting planes of support for said rolling mill stand assemblies.

4. The apparatus according to claim 3 wherein the angularly-disposed relation of the individual support surfaces of said pedestals is further defined to include an inclined support surface to the horizontal upon a first pedestal, a horizontal support surface upon the second and next adjacent pedestal, an inclined support surface to the horizontal upon the third and next adjacent pedestal, and a horizontal support surface upon the fourth and next adjacent pedestal.

5. The apparatus according to claim 3 wherein the angularly-disposed relation of the individual support surfaces of said plurality of pedestals is further defined to include an inclined support surface to the horizontal upon a first pedestal, a horizontal support surface upon the second and adjacent pedestal, an inclined support surface to the horizontal upon the third and next adjacent pedestal, and a vertical support surface upon the fourth and next adjacent pedestal.

6. The apparatus according to claim 3 wherein the angularly-disposed relation of the individual support surfaces between adjacent ones of said plurality of pedestals is further defined to include a support surface of one pedestal being arranged to support a rolling mill assembly at essentially one horizontal side of said passline, and the support surface of the next adjacent pedestal being arranged to support a rolling mill assembly at essentially the other horizontal side of said passline.

7. The apparatus according to claim 3 wherein the angularly-disposed relation of the individual support surfaces between adjacent ones of said plurality of pedestals is further defined to include the support surfaces of two adjacent pedestals being arranged to support rolling mill assemblies at essentially the same horizontal side of said passline, and the next two adjacent pedestals having their surfaces arranged to support rolling mill assemblies at essentially the other horizontal side of said passline.

8. The apparatus according to claim 3 further comprising means to adjust the position of each of the rolling mill stand assemblies relative to a support surface defined by said pedestal means for aligning the roll gap between the rolls of said assemblies with respect to said passline.

9. An apparatus for providing alternative tandem arrangements of rolling mill stands to process workpieces by successive rolling operations along a given passline, said apparatus comprising, in combination:

a plurality of separate and independently operable rolling mill stand assemblies each including housing means to rotatably support a pair of rolling mill rolls which defines a roll gap wherein a workpiece is processed, and separate drive means including a motor for rotating the rolls of each rolling mill stand assembly; and pedestal means defining a plurality of separate support surfaces each adapted to support and independently position one of said plurality of rolling mill stand assemblies at a preselected location along said passline, certain of said support surfaces being at different angular positions with respect to others and each of said stand assemblies being removable from an associated one of said support surfaces independently of the others, pedestal means include a base pedestal and a plurality of auxiliary adapted pedestals each having a mounting surface for supporting engagement with a support surface defined by said base pedestal.

10. The apparatus according to claim 9 wherein said support surfaces defined by said base pedestal are further defined by the combination of two support plates each inclined at 45° to the horizontal and secured together along abutted longitudinal edges which extend parallel to said passline, and a base plate secured to said support plates.

11. The apparatus according to claim 9 wherein said plurality of auxiliary adapter pedestals each includes a first support plate for supporting engagement with said base pedestal, and a second support plate for supporting engagement with one of said rolling mill stand assemblies.

12. The apparatus according to claim 11 wherein said second support plate for each two of said plurality of auxiliary adapter pedestals defines a rolling mill stand assembly support surface lying in a horizontal plane when the adapter pedestal is carried by said base pedestal.

13. The apparatus according to claim 11 wherein said second support plate for each of two of said plurality of auxiliary adapter pedestals defines a rolling mill stand assembly support surface which lies in a plane perpendicular to the horizontal when the adapter pedestal is carried by said base pedestal.

14. The apparatus according to claim 9 wherein said separate support surfaces define a support location by said pedestal means for each of said rolling mill stands to form part of at least two alternative tandem rolling mill arrangements which include a first tandem rolling mill arrangement wherein the rotational axes of the rolls of at least two separate mill stands form an angle of at least 45° to the horizontal, and a second tandem rolling mill arrangement wherein the rotational axes of the rolls of at least two separate mill stands form an angle less than 45° to the horizontal.

15. An apparatus for providing alternative tandem arrangements of rolling mill stands to process workpieces by successive rolling operations along a given passline, said apparatus comprising, in combination:

a plurality of separate and independently operable rolling mill stand assemblies each including housing means to rotatably support a pair of rolling mill rolls which defines a roll gap wherein a workpiece is processed, and separate drive means including a motor for rotating the rolls of each rolling mill stand assembly; and pedestal means defining a plurality of separate support surfaces each adapted to support and independently position one of said plurality of rolling mill stand assemblies at a preselected location along said passline, certain of said support surfaces being at different angular positions with respect to others and each of said stand assemblies being removable from an associated one of said support surfaces independently of the others, said pedestal means including a plurality of vertically-extending pedestals each defining an individual one of said separate support surfaces for supporting and positioning one of said plurality of rolling mill stand assemblies, said vertically-extending pedestals being arranged in a side-by-side relation along said passline such that the support surfaces of adjacent pedestals are angularly disposed and lie within intersecting planes of support for said rolling mill stand assemblies, the angularly-disposed relation of the individual support surfaces of said pedestals is further defined to include an inclined support surface to the horizontal upon a first pedestal, a horizontal support surface upon the second and next adjacent pedestal, an inclined support surface to the horizontal upon the third and next adjacent pedestal, and a horizontal support surface upon the fourth and next adjacent pedestal.

16. An apparatus for providing alternative tandem arrangements of rolling mill stands to process workpieces by successive rolling operations along a given passline, said apparatus comprising, in combination:

a plurality of separate and independently operable rolling mill stand assemblies each including housing means to rotatably support a pair of rolling mill rolls which defines a roll gap wherein a workpiece is processed, and separate drive means including a motor for rotating the rolls of each rolling mill stand assembly; and pedestal means defining a plurality of separate support surfaces each adapted to support and independently position one of said plurality of rolling mill stand assemblies at a preselected location along said passline, certain of said support surfaces being at different angular positions with respect to others and each of said stand assemblies being removable from an associated one of said support surfaces independently of the others, said pedestal means including a plurality of vertically-extending pedestals each defining an individual one of said separate support surfaces for supporting and positioning one of said plurality of rolling mill stand assemblies, said vertically-extending pedestals being arranged in a side-by-side relation along said passline such that the support surfaces of adjacent pedestals are angularly disposed and lie within intersecting planes of support for said rolling mill stand assemblies, the angularly-disposed relation of the individual support surfaces of said plurality of pedestals being further defined to include an inclined support surface to the horizontal upon a first pedestal, a horizontal support surface upon the second and adjacent pedestal, and inclined support surface to the horizontal upon the third and next adjacent pedestal, and a vertical support surface upon the fourth and next adjacent pedestal.

17. An apparatus for providing alternative tandem arrangements of rolling mill stands to process workpieces by successive rolling operations along a given passline, said apparatus comprising, in combination:

a plurality of separate and independently operable rolling mill stand assemblies each including housing means to rotatably support a pair of rolling mill rolls which defines a roll gap wherein a workpiece is processed, and separate drive means including a motor for rotating the rolls of each rolling mill stand assembly; and pedestal means defining a plurality of separate support surfaces each adapted to support and independently position one of said plurality of rolling mill stand assemblies at a preselected location along said passline, certain of said support surfaces being at different angular positions with respect to others and each of said stand assemblies being removable from an associated one of said support surfaces independently of the others, said pedestal means including a plurality of vertically-extending pedestals each defining an individual one of said separate support surfaces for supporting and positioning one of said plurality of rolling mill stand assemblies, vertically-extending pedestals being arranged in a side-by-side relation along said passline such that the support surfaces of adjacent pedestals are angularly disposed and lie within intersecting planes of support for said rolling mill stand assemblies, the angularly-disposed relation of the individual support surfaces between adjacent ones of said plurality of pedestals being further defined to include the support surfaces of two adjacent pedestals being arranged to support rolling mill assemblies at essentially the same horizontal side of said passline, and the next two adjacent pedestals having their surfaces arranged to support rolling mill assemblies at essentially the other horizontal side of said passline.

* * * * *